US006940227B2

(12) United States Patent
Aoki et al.

(10) Patent No.: US 6,940,227 B2
(45) Date of Patent: Sep. 6, 2005

(54) PLASMA DISPLAY PANEL AND MANUFACTURING METHOD THEREOF

(75) Inventors: Masaki Aoki, Minoo (JP); Taku Watanabe, Katano (JP)

(73) Assignee: Matsushita Electric Industrial Co., Ltd., Osaka-Fu (JP)

( * ) Notice: Subject to any disclaimer, the term of this patent is extended or adjusted under 35 U.S.C. 154(b) by 0 days.

(21) Appl. No.: 10/239,107

(22) PCT Filed: Mar. 22, 2001

(86) PCT No.: PCT/JP01/02289

§ 371 (c)(1),
(2), (4) Date: Sep. 19, 2002

(87) PCT Pub. No.: WO01/71761

PCT Pub. Date: Sep. 27, 2001

(65) Prior Publication Data

US 2003/0038599 A1 Feb. 27, 2003

(30) Foreign Application Priority Data

Mar. 24, 2000 (JP) ..... 2000-084284

(51) Int. Cl.[7] ..... H01J 17/49
(52) U.S. Cl. ..... 313/586; 313/582; 313/584
(58) Field of Search ..... 313/582, 584, 313/586

(56) References Cited

U.S. PATENT DOCUMENTS 4,958,172 A 9/1990 McCallum et al.
5,326,298 A 7/1994 Hotomi
6,242,859 B1 6/2001 Betsui et al.
6,399,221 B1 * 6/2002 Marks et al. ..... 313/504

FOREIGN PATENT DOCUMENTS

| | | |
|---|---|---|
| JP | 2-24935 | 1/1990 |
| JP | 2-153760 | 6/1990 |
| JP | 04215239 A | 8/1992 |
| JP | 05020924 A | 1/1993 |
| JP | 05047305 A | 2/1993 |
| JP | 10125221 A | 5/1998 |
| JP | 10-340656 | 12/1998 |
| JP | 111678771 A | 6/1999 |
| JP | 11354027 A | 12/1999 |
| JP | 2001035390 A | 2/2001 |
| JP | 2001135222 A | 5/2001 |

* cited by examiner

*Primary Examiner*—Vip Patel

(57) ABSTRACT

A plasma display panel that requires lower consumption power to drive is proved. This plasma display has a good luminance efficacy, is less tending to yellowing of glass and deterioration of phosphors, and is manufactured at a low cost. The dielectric layers and ribs of the PDP are made from a silicone resin containing polysiloxane bond. Preferably, the silicon resin should have siloxane bond joined with methyl group, ethyl group or phenyl group. It is also preferable that a sealing member is made from a silicone resin.

22 Claims, 8 Drawing Sheets

PLASMA DISPLAY PANEL AND MANUFACTURING METHOD THEREOF

TECHNICAL FIELD

The present invention relates to a plasma display panel for use in color television sets.

BACKGROUND ART

In recent years, there has been a growing demand for the realization of large-screen televisions with superior quality. One example of such televisions is televisions for the "HiVision" standard used in Japan. In the field of display devices, development has been underway for a variety of display devices, such as CRTs, liquid crystal displays (hereafter referred to as LCD) and plasma display panels (hereafter referred to as PDP) with the aim of producing suitable televisions.

CRTs have been conventionally used as displays of televisions and offered superior resolution and picture quality. However, the depth and weight of CRT televisions increase with screen size, so that CRTs are not suited to the production of large televisions with screen sizes of 40 inches or more. As for LCDs, they have some notable advantages, such as low power consumption and low driving voltages, but it is technically difficult to produce large-screen LCDs.

On the other hand, PDPs enable large-screen slimline televisions to be produced, with fifty-inch models already having been sold on the market.

PDPs can be roughly divided into direct current (DC) type and alternative current (AC) type. At present, the AC-types, which are suited to the production of panels with fine cell structures, are prevalent.

A representative AC-type PDP is described hereafter. Display electrodes are provided on a front glass plate in the form of stripes. This glass plate is arranged in parallel with a back glass plate on which the address electrodes are provided in the form of stripes. The display electrodes are covered with a protective layer made up of a dielectric layer and a magnesium oxide (MgO) layer. The address electrodes are covered with a dielectric layer on which ribs are provided so as to interpose neighboring address electrodes. Gaps left between the ribs are filled with phosphor layers. A space between the plates is partitioned by the ribs, into which a discharge gas such as Ne—Xe gas is introduced.

The dielectric layers on the front glass plate and back glass plate can serve as a memory when the PDP is driven. They are usually made of glass with a low melting-point, such as lead oxide (PbO) and bismuth oxide ($Bi_2O_3$). The dielectric layer on the back glass plate is made from a mixture of a low melting-point glass and a white pigment such as $TiO_2$ and $Al_2O_3$.

However, as the low melting-point glass has a high dielectric constant, 10 to 13, forming a dielectric layer from such low melting-point glass will increase the capacitance of a discharge cell. This means that larger amounts of discharge current would pass in each period of address and sustain discharges. This would increase power consumption of the PDP. The power consumption of the PDP becomes particularly large when the frequency at which the PDP is driven is set at a high level, for instance at 200 KHz or more, with the aim of increasing its luminance.

Another factor that could increase PDP's power consumption is the use of a low melting-point glass for the ribs. Such glasses, including PbO and $Bi_2O_3$, affect the capacitance of the discharge cells.

A possible solution to these problems is to use a low melting-point glass, other than PbO and $Bi_2O_3$. Among those glasses are $Na_2O$—$B_2O_3$—$SiO_2$, $Na_2O$—$B_2O_3$—ZnO, and $Na_2O$—$B_2O_3$—$SiO_2$. They have lower dielectric constants, 6 to 7. By using them for the dielectric layers and ribs, power consumption of the PDP is lowered.

However, such glasses contain higher portions of $Na_2O$ (sodium oxide), $K_2O$ (potassium oxide), $Li_2O$ (lithium oxide). These compounds tend to react with transparent electrodes (ITO), and damage their conductivity. The compounds also react with metal electrodes, causing Cu and Ag contained in the metal electrodes to spread into the dielectric glasses and onto the glass plates. As a result, the glass plates and the dielectric layers turn yellow and withstand pressure of the dielectric layer decreases.

When a glass of this type is used for the ribs, while the phosphors are sintered, $Na_2O$ in the glass reacts with the phosphors. This lowers the luminance of phosphoric layers.

Japanese Patent Application No. H9-199037 teaches a technique for forming dielectric layers. In this technique, a lower dielectric layer is formed by applying a PbO glass to metal electrodes and transparent electrodes, and sintering them. An upper dielectric layer is formed by applying and sintering $Na_2$—$B_2O_3$—$SiO_2$ glass that has a lower dielectric constant. With this method, the diffusion of Ag and Cu can be prevented and the dielectric constant is kept relatively low. To prevent the diffusion of Ag and Cu completely, however, the lower dielectric layer must have sufficient thickness. Then, it becomes difficult to drastically reduce dielectric constant of the whole dielectric layer.

Another challenge in forming dielectric layers and ribs from a low melting-point glass is cost. After the low melting-point glass is applied, the glass is sintered at temperatures 500–600 degrees C. But this sintering process requires substantial amount of time and energy, and it has been requested to reduce that time and energy and manufacturing costs.

The dielectric layers can also be formed from $SiO_2$ having a low dielectric constant by deposition or sputtering method.

However, it is difficult in terms of time and cost to produce 20–30 $\mu$m thick films with deposition and sputtering method. In addition, there is a higher likelihood of cracks being formed in $SiO_2$ layers that have grown more than 10 $\mu$m thick. Therefore, it seems virtually impossible to reduce capacitance of dielectric layers if they are made of $SiO_2$.

DISCLOSURE OF INVENTION

It is an object of the present invention to provide a PDP that has good luminance efficiency, requires low manufacturing costs, and is protected to some extent from the yellowing of glasses and degradation of phosphors.

To achieve the above object, a PDP of the present invention have dielectric layers and ribs that are made of a silicon resin including polysiloxane bond. It is preferable to use a silicon resin in which a Si atom of the siloxane bond is bonded with a methyl group, ethyl group, or phenyl group.

It is also preferable to use silicon resins as a material for a sealing layer.

This silicon resin has three-dimensional web-like form and has excellent heat resistance, aging resistance, and electric insulation.

The dielectric constant of the silicon resin is generally 4.0 or below. Compared with the conventional dielectric layer made of a low melting-point glass, the dielectric layer in the PDP of the present invention has much lower dielectric constant. That would mean the capacitance of discharge cells is reduced. Therefore, the PDP of the present invention requires lower consumption power for driving panels, while achieving improved luminance efficiency.

In addition, dielectric layers and ribs made of silicon resins, as represented by the PDP of the present invention, become hard at 300° C. or below. So, there is no need to sinter the dielectric layers at high temperatures as with the case of sintering glass-made dielectric layers. This reduces energy at the time of manufacturing, and therefore reduces costs. Also, the damage of yellowing of glass plates and dielectric layers, which is caused by the diffusion of Ag and Cu, is contained in such dielectric layers. This improves the quality of emission colors produced from the PDP.

By using silicon resins, it is easy to form thick films, 20 μm or over. This means that dielectric layers and ribs can be easily formed, and unlike $SiO_2$, there are no cracks in a produced thick film.

BEST MODE FOR CARRYING OUT THE INVENTION

Explanation on the Entire Structure of PDP

Figure 1:
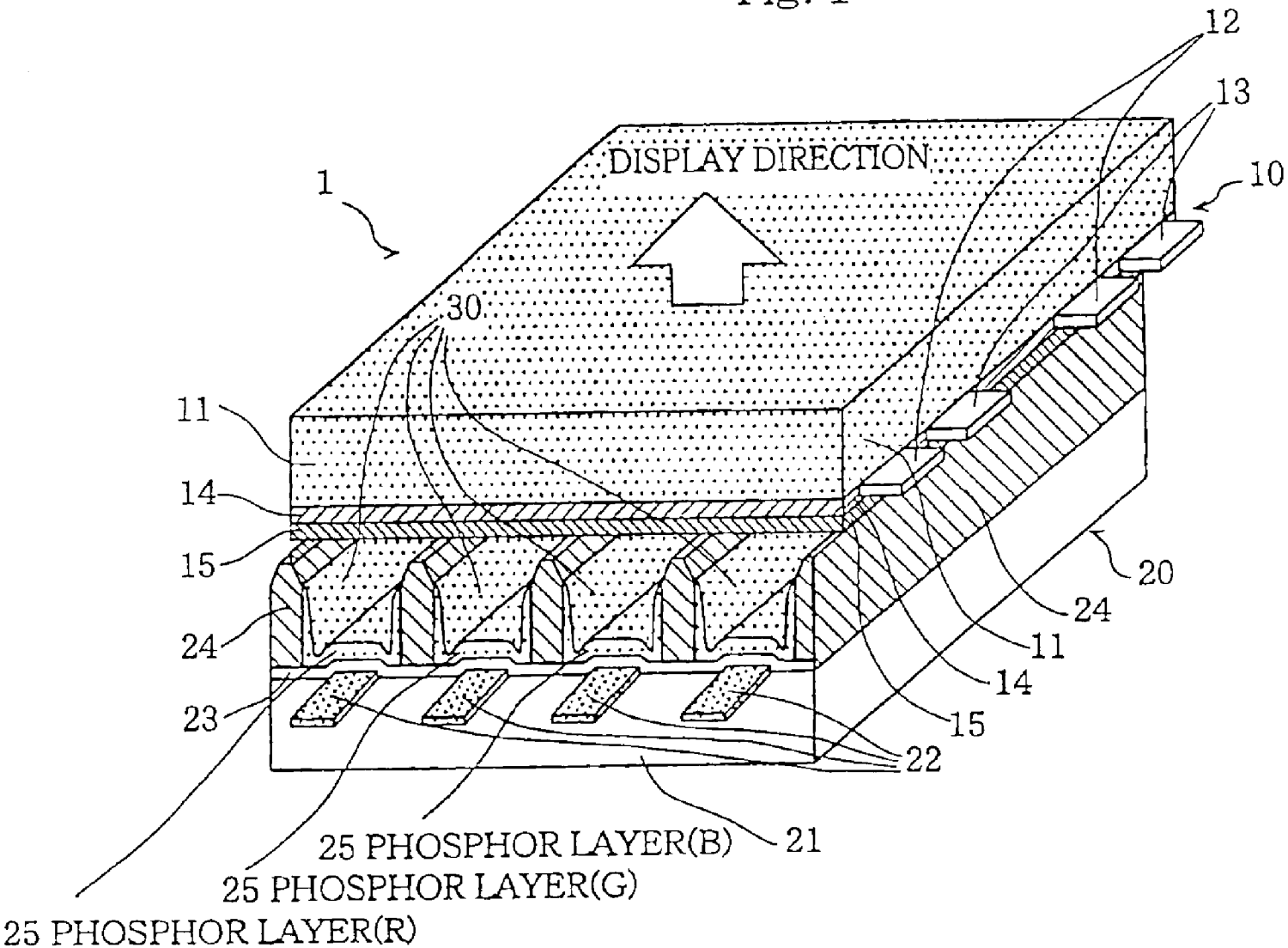
FIG. 1 is a perspective view showing main parts of a PDP in an embodiment according to the present invention.

FIG. 1 is a perspective view showing main parts of an AC-type PDP1 which is an embodiment of the present invention. FIG. 1 mainly depicts a display area, which is located at the center of the PDP1.

The PDP1 consists of a front panel 10 and a back panel 20. The front panel 10 is composed of display electrodes (scanning electrodes 12 and sustain electrodes 13), a first dielectric layer 14 and a protective layer 15. They are all provided on a front glass plate 11. The back panel 20 is composed of address electrodes 22 and a second dielectric layer 23 which are provided on a back glass plate 21. A space left between the front panel 10 and the back panel 20 is divided into discharge spaces 30 with ribs 24 arranged in the form of stripes. A discharge gas is enclosed in the discharge spaces 30. The ribs 24 are arranged in parallel to the address electrodes 22 on the back panel 20, serving as a gap member to determine the size of the space between the front panel 10 and the back panel 20. The front panel 10 and the back panel 20 are joined together by means of a sealing layer, which is provided at their end portions.

Phosphor layers 25 are between the ribs 24 on the back panel 20, that is, in the discharge spaces 30. There are three colors of phosphor layers, namely, red, green and blue. They are alternately arranged in the stated order.

The display electrodes 12–13 and the address electrodes 22 are formed in the shape of stripes, crossing with each other. Light is produced from a particular discharge space 30 at which a scanning electrode 12 crosses an address electrode 22. In other words, discharge cells of these three colors are arranged in a matrix in this PDP1.

The address electrodes 22 are made of a metal (for instance, Ag or Cr—Cu—Cr electrodes).

Figure 2:
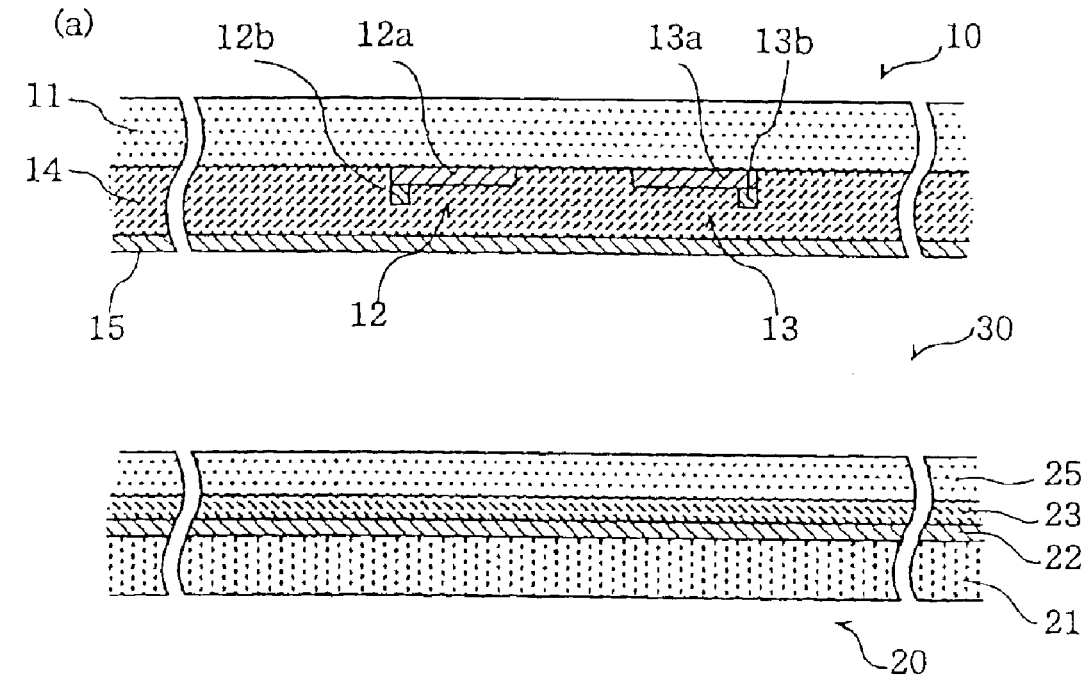
FIG. 2 is a cross-sectional view showing main parts of the PDP.
Figure 2:
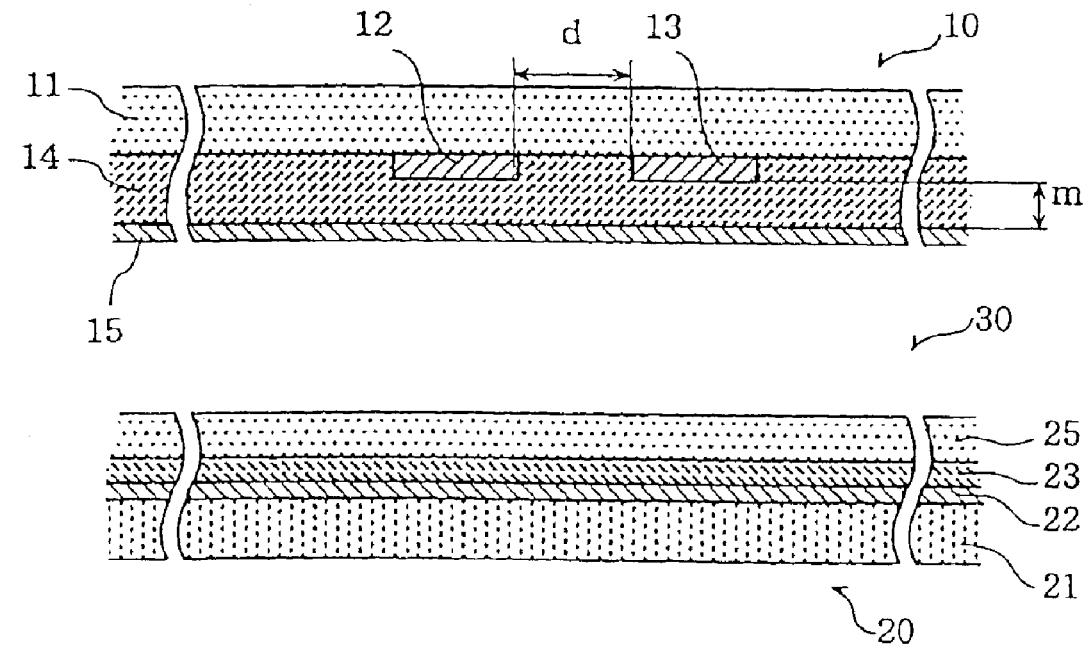

FIG. 2 is a cross-sectional view showing main parts of the PDP of FIG. 1.

The display electrodes 12–13 are formed of transparent electrodes 12*a* and 13*a* and bus electrodes 12*b* and 13*b* (Ag electrodes or Cr—Cu—Cr electrodes). The bus electrodes 12*b* and 13*b* are laminated on the transparent electrodes 12*a* and 13*a*, as shown in FIG. 2(*a*). The transparent electrodes 12*a* and 13*a* are about 150 μm and made of a conductive metal oxide, such as ITO, $SnO_2$ and ZnO. The bus electrodes are as narrow as 30 μm. The display electrodes 12–13 may be made of a metal, as the address electrodes 22 are.

It is preferred in most cases to form the display electrodes 12–13 in layers so as to ensure broader discharge areas for the discharge cells and lower resistance of the electrodes. But it is more advantageous to make the display electrodes 12–13 from a metal, because this could reduce the capacitance of the panel and make it easier to manufacture it. This is especially true when the PDP has a fine structure.

The first dielectric layer 14 is a layer composed of a dielectric substance, which covers the overall surface of the front glass plate 11 on which the display electrode 12 has been provided. The first dielectric layer 14 has a thickness in the range of 15 μm to 40 μm. As will be described later, the first dielectric layer 14 is formed of a silicon resin containing polysiloxane bond, and has a dielectric constant of 4 or below.

The protective layer 15 is a thin MgO layer, covering the overall surface of the first dielectric layer 14.

The second dielectric layer 23 is formed from a mixture of a white pigment and a silicone resin. The white pigment is particles of silicon oxide ($SiO_2$) or titanium oxide ($TiO_2$). The same silicone resin as that for the first dielectric layer 14 is used. The second dielectric layer is about 15 μm thick, and serves as a layer to efficiently reflect emitted visible light towards the front panel 10. The silicon resin is mixed with the white pigment at the ratio of 10 wt % to 30 wt %.

The ribs 24 are formed on the surface of the second dielectric layer 23 at a predetermined pitch. Their height is about 100 μm. The ribs 24 are formed of a mixture of the silicon resin and white pigment, the same material for the second dielectric layer 23.

The phosphoric layers 25 are formed by arranging phosphoric particles in layers in grooves between neighboring ribs 24, and then sintering them. Their dielectric constant is about 5.

| | |
|---|---|
| Red phosphors: | $Y_2O_3$: $Eu^{3+}$ |
| Green phosphors: | $Zn_2SiO_4$:Mn |
| Blue phosphors: | $BaMgAl_{10}O_{17}$: $Eu^{3+}$ |

Description About a Manufacturing Method of PDP1

The following is a manufacturing method of the PDP1.

A. Manufacturing Front Panel 10

Display electrodes 12–13 are formed on the surface of the front glass plate 11.

The display electrodes 12–13, which is a combination of transparent electrodes and bus electrodes, is formed by making a uniform ITO film, about 0.12 μm thick, by sputtering method. The ITO film is formed in the shape of stripes by photolithography or laser beam machining, to form the transparent electrodes 12*a* and 13*a*.

Then, photosensitive Ag paste is applied to the overall surface of the front glass plate 11. It is made in the shape of stripes by photolithography and heated at 550° C. The resulting sintered Ag paste becomes the bus electrodes 12*b* and 13*b* and provided on the transparent electrodes 12*a* and 23*a*.

The display electrodes 12–13 can be formed simply from a metal by applying a photosensitive Ag paste on the overall surface of the glass plate 11 and by transforming it into Ag electrodes with photolithography. The display electrodes 12–13 may also be formed by producing a Cu layer, Cr layer and Cr layer by sputtering, and by transforming those layers into Cu—Cr—Cr electrodes by photolithography.

Next, a silicon film is formed over the display electrodes 12–13 on the front glass plate 11. The film is heated and cured, to produce the first dielectric layer 14.

The following is an explanation about silicone, a material for the dielectric layers.

Silicone is a polymer made up of a principal chain cable of repeating siloxane bonds (—Si—O—)n and lateral groups of alky group and aryl group. Depending on the degree of polymerization and the cross-linkage and the kind of lateral groups, it is provided in a variety of forms, including a liquid, grease, rubber and resin. Silicone that has a linear form, low polymerization degree and is fluid at normal temperatures is called silicone oil, which is usually a polymer of dimethyldichlorosilane (See Physical and Chemical Dictionary published by Iwanami Shoten).

A book titled "Plastic Encyclopedia" (published by Asakura Shoten Inc. Mar. 1, 1992, pp. 281–298) provides description as follows.

Silicone is an organic silicon polymer that has polysiloxane bonds. The polysiloxane bonds are bonded with methyl group (—$CH_3$), ethyl group (—$C_2H_5$) and phenyl group (—$C_6H_5$), to form an organopolysiloxane bond.

This silicone is usually provided in the form of a silicone varnish dissolved in an organic solvent. When it is heated, the shape of silicone changes into a mesh-like form, and its cross-linkage is hardened.

Silicone is largely divided into two groups; (a) straight silicone, and (b) denatured silicone.

(a) Straight silicone is obtained by dissolving organochlorosilane selected from the group consisting of methyltrichlorosilane (T unit), dimethyltrichlorosilane (D unit), phenyltrichlorosilane (T unit), diphenyltrichlorosilane (D unit) and methylphenyldichlorosilane (D unit) in an organic solvent and hydrolyzing them in water (Note that D unit refers to double sensuality and T unit refers to triple sensuality). The combination of such silane compounds determines most of the characteristics of a cured film. For example, a film containing higher portions of D units of silnane is softer, because D units of silane do not usually form a chain.

(b) Denatured silicone is formed by firstly oligomerizing D units and T units of siloxane to form siloxane intermediates with function groups (e.g. Si—OH, Si—OMe), and then by blending them with resins, such as epoxy resin, phenol resin, acryl resin, polestar resin and alkyl resin. The mixture is cooked and denatured.

For the PDP in this embodiment, it does not matter whether straight silicone or denatured silicone is used. There is a more specific description in the section of Examples about a PDP that uses these silicones.

The silicone is put on the front glass plate 11, after the display electrodes 12–13 are formed on it, which produces a silicone film. There are two methods for forming the silicone film, which are the following.

In the first method, viscosity of a liquid silicone (silicone oil) is firstly adjusted by adding a solvent such as xylene. Then, the liquid silicone is applied to the plate and dried.

The liquid silicone can be applied either by dye coat process or screen printing, which are the conventional methods. But it can also be applied by spin coating.

The second method uses a film transfer process. According to this method, silicone is applied to a PET film, which is a substrate for printing use. When it is dried, it forms a dielectric green sheet. The dielectric green sheet is transferred to the front glass plate 11 by means of laminator so as to cover the formed display electrodes 12–13.

Figure 3:
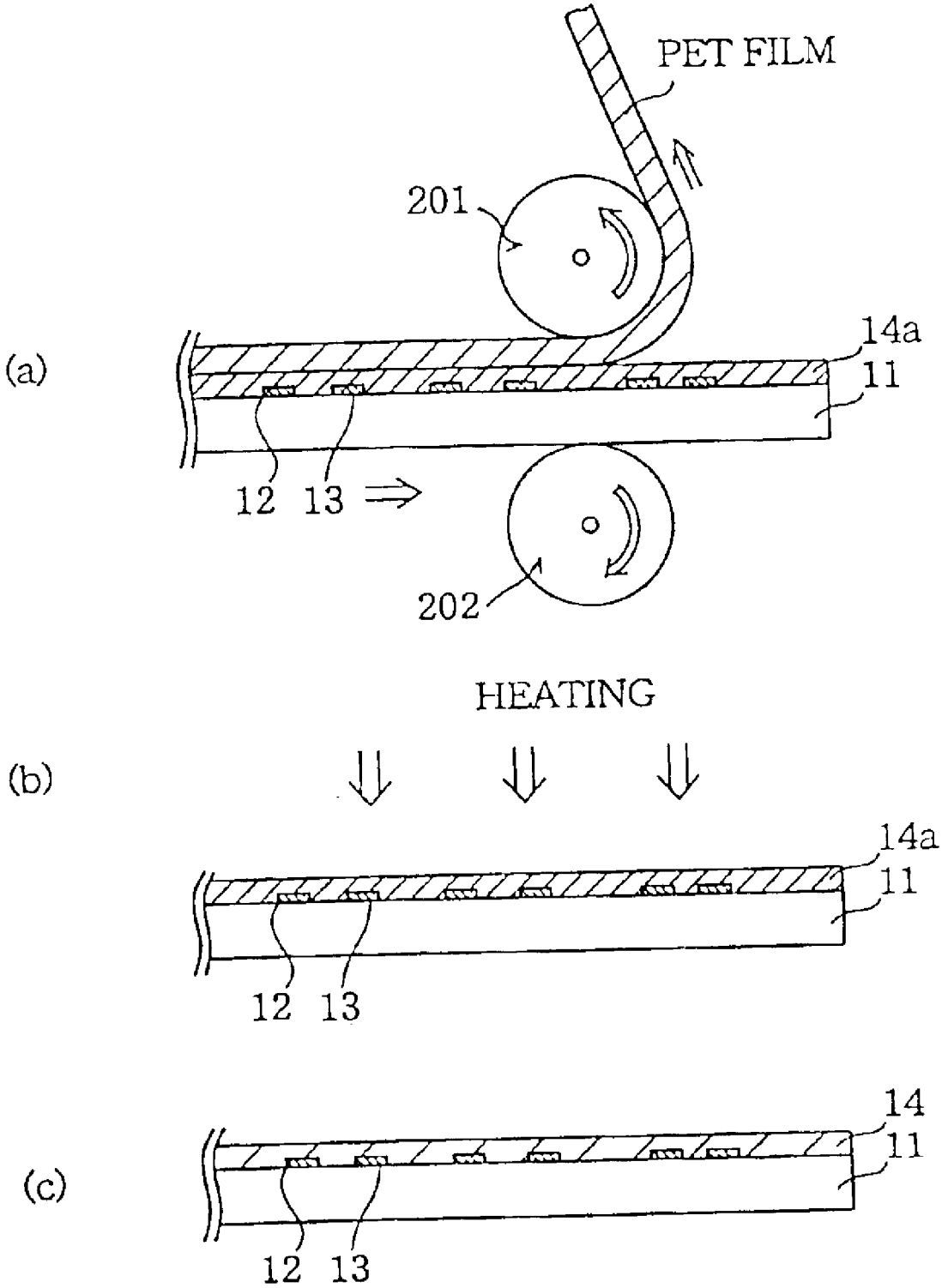
FIG. 3 is a diagram showing the workflow of producing a dielectric layer using a silicon resin with film printing method.

More specifically, the front glass plate 11 is heated after the display electrodes 12–13 are formed on it. One dielectric green sheet is placed on top of the electrodes, as shown in FIG. 3(*a*). They are inserted between a pair of laminator rollers 201 and 202, laminated, and forms a silicone film 14*a*.

The following describes the curing process for the silicone film.

The silicone film 14*a*, made by any one of the above methods, is heated at temperatures 200–300 degrees C., as shown in FIG. 3(*b*). This makes the silicone film 14*a* hard, and transforms it into a silicon resin. The formed resin has three-dimensional mesh structure. As a result of this process, the first dielectric layer 14 is formed as shown in FIG. 3(*c*).

Note that the curing temperature is much lower than 500–600 degrees C., which is a sintering temperature for a conventional low melting-point glass.

Then, the protection layer 15 made of MgO is formed on the dielectric layer 14. This protective layer 15 can be produced by such methods as vacuum deposition, sputtering, ion plating and CVD (thermal CVD or plasma CVD).

B. Manufacturing the Back Panel 20

The address electrodes 22 are formed on the surface of the back glass plate 21 in the form of stripes with some intervals. This is done by screen-printing and sintering Ag paste.

Then, the second dielectric layer 23 is formed all over the surface of the back glass plate 21, the surface on which the address electrodes 22 are formed.

The second dielectric layer 23 is formed in virtually the same way as in the first dielectric layer 14. Which is to say, 10 wt % of $SiO_2$ particles are added to a silicone, which is the same silicone as that for the first dielectric layer 14. The $SiO_2$ particles have an average diameter of 0.1 $\mu$m to 0.5 $\mu$m. They are used as a white pigment. The resulting mixture is applied to the back glass plate 21 and dried, forming a silicone film. The silicone film may be formed by film transfer process. The formed silicone film is heated at temperatures of 200–300 degrees C. until to be cured, and thus the second dielectric layer 23 is produced.

Then, the ribs 24 are formed on the second dielectric layer 23 and between any neighboring address electrodes 22. The ribs 24 are made from the same material as that for the second dielectric layer 23, which is, a mixture of silicone and a white pigment. The mixture is molded in the shape of the ribs 24, and heated at temperatures of 200–300 degrees C. to be cured.

C. A Method of Molding Ribs

In addition to screen-printing method, by which a rib material is repeatedly applied to a limited area, there is another method to form ribs. According to this method, rib material is applied to all over the surface, and the resulting rib-material layer is press-molded or fabricated by sand blast. The following explains the method.

Figure 4:
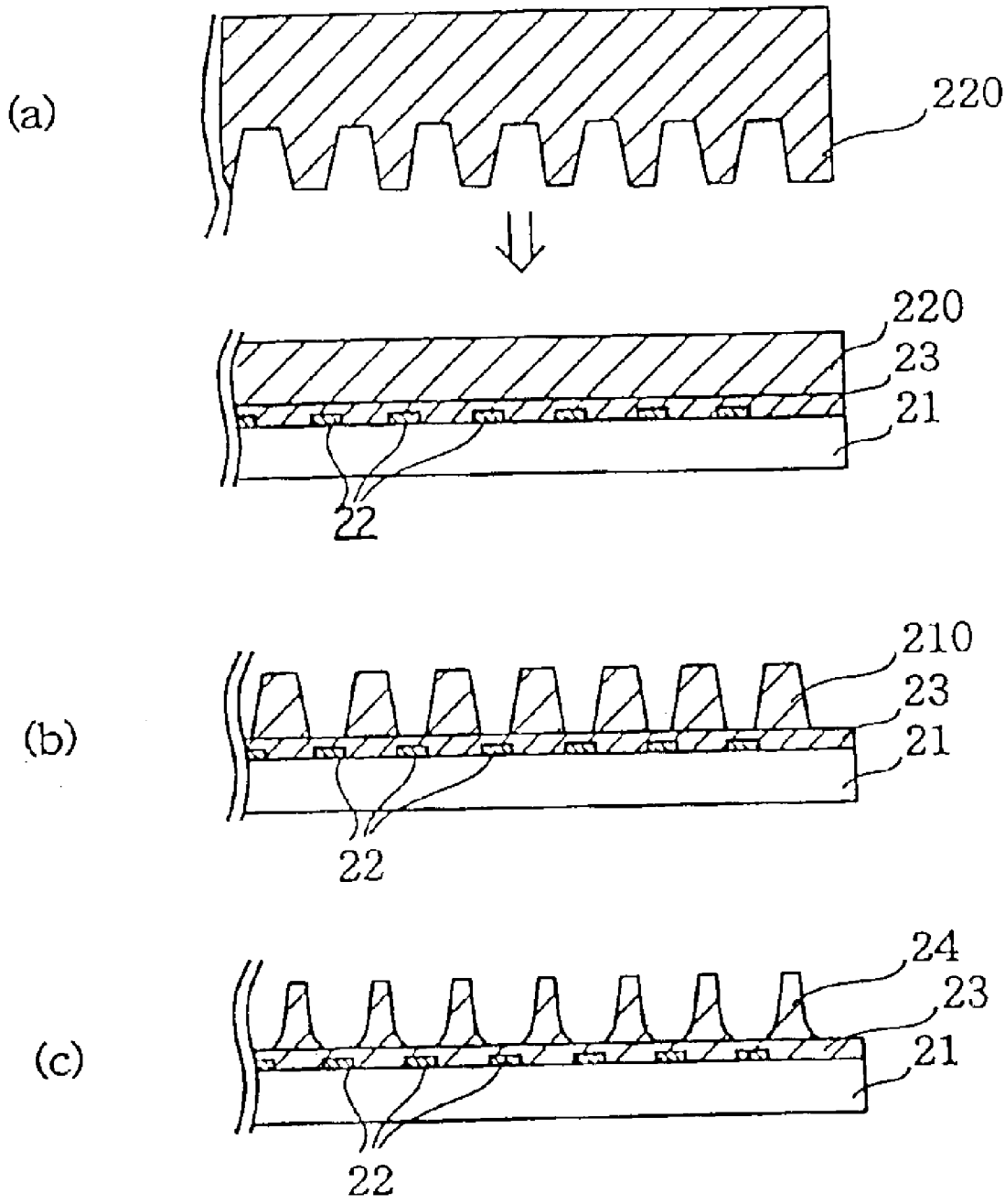
FIG. 4 is a diagram showing the workflow of producing ribs using a silicon resin by means of moulds.

FIG. 4 shows a method for forming ribs by means of molds. The rib material is applied all over the surface of the back glass plate 21, the surface on which the address electrodes 22 are formed, as shown in FIG. 4(*a*). A produced rib-material layer 210 is press-molded in a mold 220 which has a patterned surface corresponding to the ribs. This transforms the rib-material layer 210 into an intended rib shape.

FIG. 4(*b*) shows the rib-material layer 210 that is patterned according to the shape of ribs. The back glass plate 21 is heated to make the rib-material layer 210 hard, and thus the ribs 24 are formed as shown in FIG. 4(*c*).

The order of forming the rib material can be reversed. As shown in FIG. 4(*b*), the rib material is filled in the concave parts of the mold 220. It is pressed against the surface of the back glass plate 21, the surface on which the address electrodes 22 are formed for the purpose of transferring.

Figure 5:
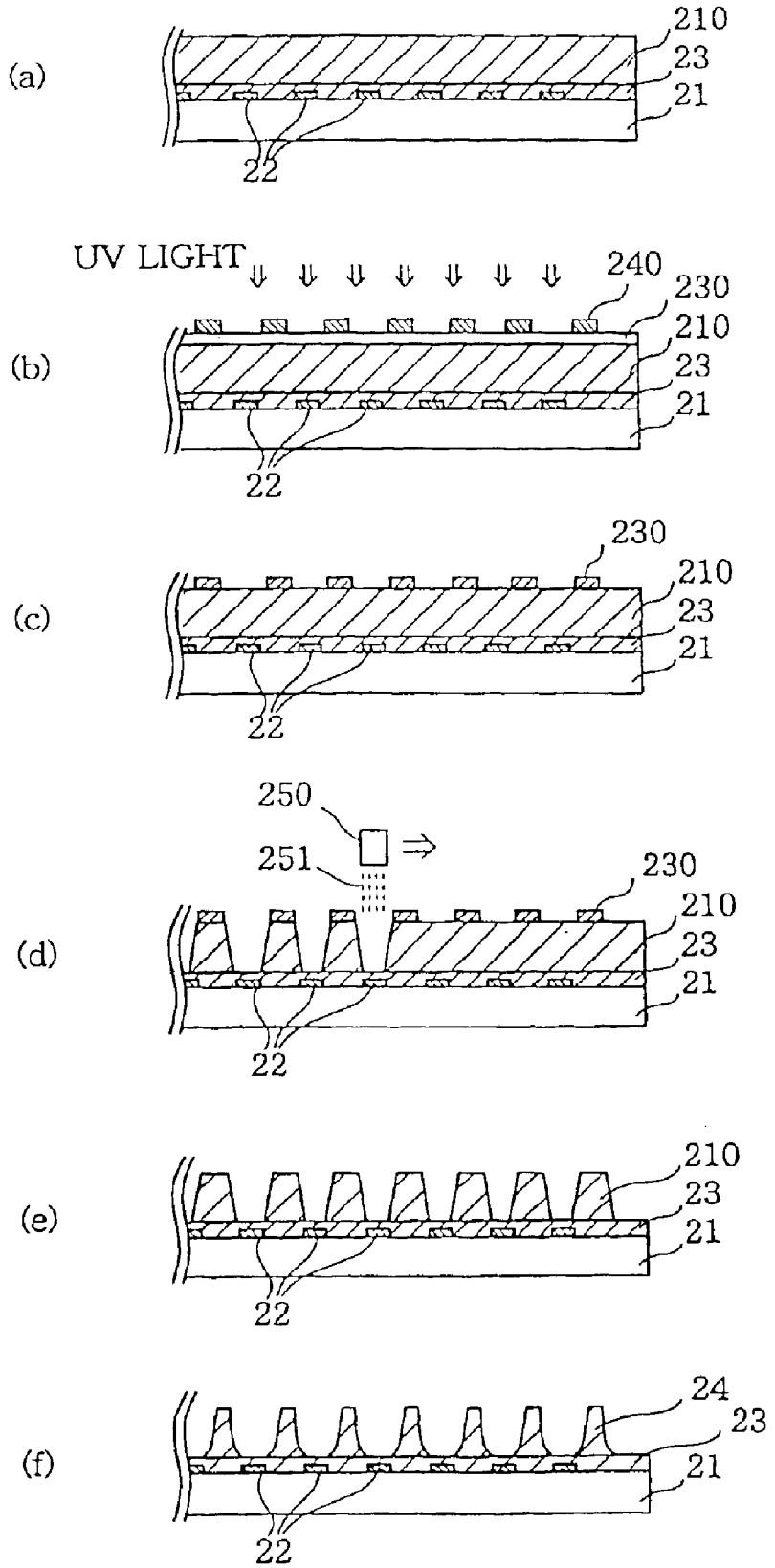
FIG. 5 is diagram showing the workflow of fabricating a rib-material layer by sand blast.

FIG. 5 shows a method for fabricating the rib-material layer by sand blasting.

The rib-material layer 210 is formed all over the back glass plate 21 after the address electrodes 22 are formed, as shown in FIG. 5(*a*). A coating film 230 is formed by laminating a photosensitive dry film resist (hereafter referred to as DFR) on the rib-material layer 210, which is shown in FIG. 5(*b*). Then, a photo mask 240 corresponding to the rib patterns is provided on the coating film 230. The photo mask 240 is exposed to ultraviolet light and rinsed in water soon after the DFR is developed. As a result, the parts of the coating film 230 that have been exposed to ultraviolet light are removed, while the parts corresponding to the rib pattern remain there, as shown in FIG. 5(*c*).

An abrasive (e.g. glass beads) 251 is sprayed to the formed coating film 230 from a blast nozzle 250. The blast nozzle 250 moves over the entire surface of the coating film 230, as indicated by the outline arrow in FIG. 5(*d*). This removes unnecessary parts of the rib-material layer 210 and transforms it to the ribs.

After the blasting, the back glass plate 21 is soaked in a solution to remove the coating film 230. FIG. 5(*e*) shows a rib-material layer 210 formed in the shape of ribs. By heating and hardening the rib-material layer 210, the ribs 24 are formed as shown in FIG. 5(*f*).

Then, the phosphor layers 25 are formed in grooves between the ribs 24.

The phosphor layers 25 are formed by applying fluorescent ink to the groves. The fluorescent ink includes red phosphor (R), green phosphor (G) or blue phosphor (B) ink. The resulting layers are dried and sintered, and thereby the phosphor layers 25 is formed.

Besides the screen printing and other conventional methods, there is a method for applying the fluorescent ink, such as line jet method. This method enables the phosphor ink to be applied evenly to the grooves even in a fine-structured panel.

Each color of fluorescent ink is made by stirring a mixture of 50 wt % phosphor particles, 1.0 wt % organic binder (ethyl cellulose) and 49 wt % solvent (a mixture of α-terpineol and butyl carbitol). The phosphor particles have an average diameter of 2.0 μm. The mixture is stirred with a sand mill.

Figure 6:
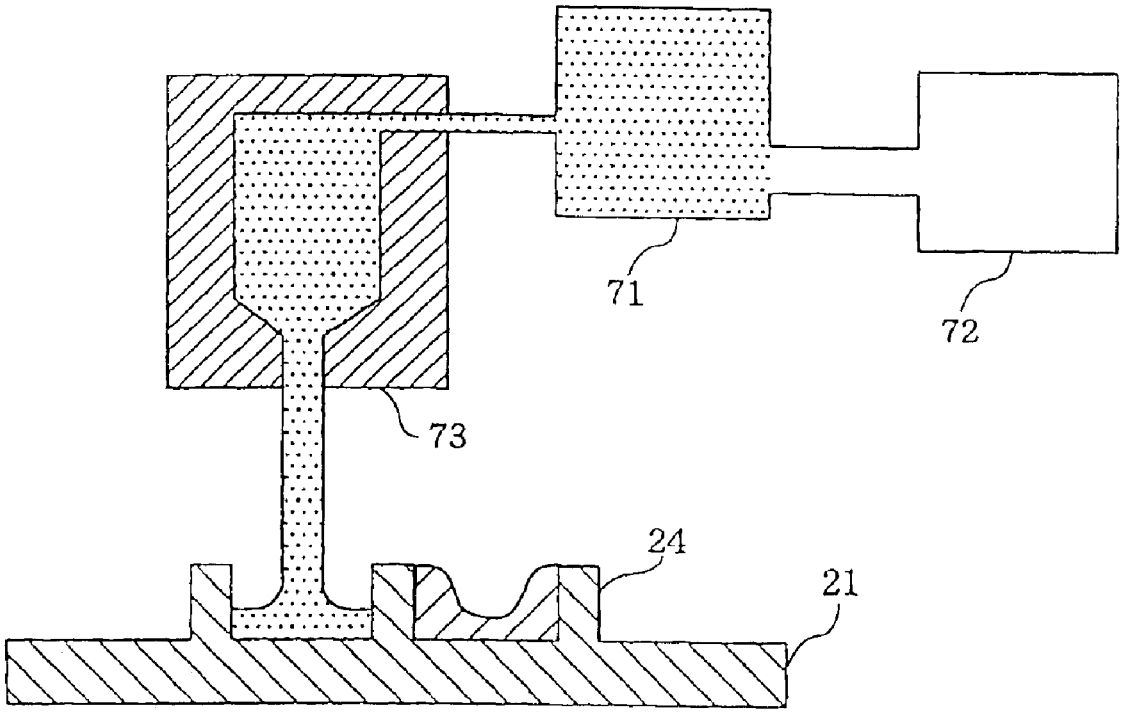
FIG. 6 is a schematic diagram showing an apparatus for applying fluorescent ink that is used in an embodiment.

FIG. 6 is a schematic view of an apparatus for applying fluorescent ink. The viscosity of red phosphor ink is firstly adjusted to 500 centipoises (CP) before the ink is put in a server 71 of FIG. 6. The red phosphor ink is sprayed from a nozzle part 73 (with a nozzle 60 μm in diameter) of a fuel injection equipment due to the pressure applied by a pump 72. The ink is applied to grooves between neighboring ribs, while the substrate is shifted in a straight line.

Likewise, blue phosphor ink and green phosphor ink are applied to the grooves. When they are sintered, an organic binder burns out, and thus the phosphor layers 25 are formed.

Generally, the phosphor layers 25 are sintered at temperatures about 500 degrees C. But in this embodiment, the phosphors should preferably be sintered at lower temperatures (for example, 300–350 degrees C.) because the second dielectric layer 23 and the ribs 24 are formed from silicone resins.

But if the organic binder in the phosphor ink is made of an acryl resin, it can burn out at about 250 degrees C. Using the acryl resin is preferable because it enables the sintering to be performed at lower temperatures.

D. Bonding Panels

As a component used to join such manufactured front panel 10 and back panel 20 together, an uncured sealing member layer is formed on the edge of the front panel 10 and/or the back panel 20, by applying a sealing member. The panels are arranged so as to face with each other, before being subjected to the heating process.

The uncured sealing member layer can be formed by employing the conventional frit glass for the sealing purpose. But it is preferable to use silicone, the same material as used for the dielectric layer 14, because silicone can be cured at temperatures of 200–300 degrees C., which are relatively low.

After this, air and gases are removed from the interior spaces of both panels to create a high vacuum (about $1.1\times10^{-3}$ Pa). A discharge gas is put in the vacuum with a predetermined pressure.

The PDP1 is produced in this way. Additional application of the sealing member at the top of the ribs 24 would increase the bond between the front panel 10 and the back panel 20. Even when a pressure at which the discharge gas is supplied is higher than atmospheric pressure, it would ensure a high PDP1's structural strength.

Driving PDPs

Figure 7:
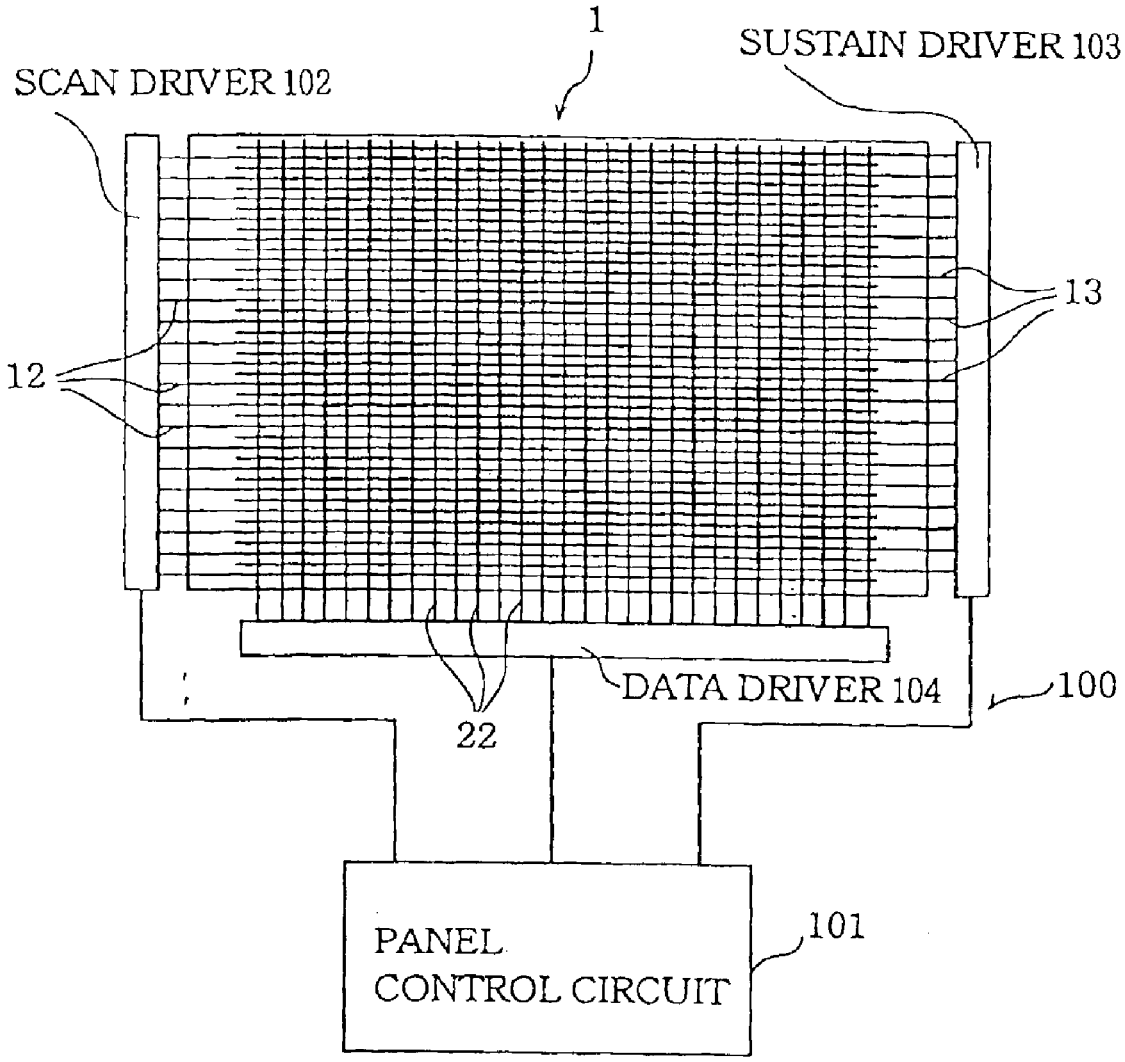
FIG. 7 shows the construction of a PDP display device that is the above PDP with a driving circuit being connected.

FIG. 7 shows the construction of a PDP display apparatus, which is composed of the PDP1 and a driving circuit 100 being connected thereto.

As shown herein, a scan driver 102 is connected to the scanning electrodes 12, a sustain driver 103 to the sustain electrodes 13, and a data driver 103 to the address electrodes 22. These drivers 102–104 are connected to a panel control circuit 101. As will be described below, the panel control circuit 101 instructs the drivers 102–104 to apply voltage to the respective electrodes 12, 13 and 22.

The driving circuit 100 drives the PDP1 by executing the following procedure.

During an initializing period, initializing pulses are applied to every scanning electrode 12 at a time, so that every discharge cell is initialized.

During an address period, scanning pulses are successively applied to the scanning electrodes 12, while data pulses are applied to the selected address electrodes 22. This causes an address discharge near the surface of the MgO protective layer in a particular discharge cell.

The discharge initializing voltage is determined based on the distance between a discharge electrode and an address electrode, the kind and a pressure of an enclosed gas, the kind and width of the dielectric layer, and the width of the MgO protective layer.

When a discharge is initiated, positive ions and electrons are generated due to the ionization of a discharge gas, and positive ions start moving towards negative electrodes while electrons moves towards positive electrodes. They charge inner walls of the MgO protective layer with electricity, but the MgO protective layer has so high a resistance that the electric charge stored in an inner wall does not decrease. Instead, it is kept there and become wall charge.

The wall charge is stored in the dielectric layer 14 of a selected discharge cell, and one screen of pixel information is written. During a discharge sustain period, AC sustain pulses are applied to every pair of display electrodes 12 and 13 at a time for a predetermined period.

When an initial sustain impulse is applied, electric potential on the surface of the protective layer becomes greater than a discharge starting voltage. As a result, discharge current passes through discharge cells where the wall charges have been accumulated during the address period. Once a discharge takes place, the luminescence is maintained in the discharge cell as long as AC sustain pulse is applied. If no wall charge is stored during the address period, electric discharge does not occur in the discharge cell even though sustain pulse is applied.

In this way, image is displayed when some discharge cells that have been charged with wall charge are illuminated.

At the end of the discharge sustain period, wall charge remaining in discharge cells is eliminated by applying narrow removing pulses to the scanning electrodes 12 all at once.

The Effect of the PDP in This Embodiment

The dielectric layers and ribs of the PDP in this embodiment are made from a silicon resin. This reduces its dielectric constant tremendously, compared with conventional glass dielectric layers.

The dielectric constant of silicone-made dielectric layers and ribs is in the range of 2.5–4.0, mostly in the range of 2.6–3.2. These are far lower values from the standard of the dielectric constant of conventional dielectric glass (10–13).

There is a description about the low dielectric constant of a silicone resin and its low curing temperatures in Monthly Semiconductor World, published in December 1996, pp. 146–150, and Plastic Encyclopedia which is mentioned above.

The following considers a relationship between dielectric constant of the dielectric layer $\in$ and consumption power of the PDP W.

Where an area of the display electrodes 12–13 is S and the thickness of the dielectric layer on the display electrodes is m (See FIG. 2(*b*)), capacitance of spaces between the display electrodes C (a capacitance of dielectric existing in channels and discharge space) is obtained by the following equation 1, $$C=\in S/m \qquad \text{(Equation 1)}$$

Where a voltage applied between the display electrodes is V and a frequency for driving a panel is f, consumption power W that the panel consumes is obtained by the following equation 2, $$W=fCV^2 \qquad \text{(Equation 2)}$$

From equation 1, it is assumed that capacitance C varies in proportion to dielectric constant $\in$. From equation 2, it is assumed that when driving frequency f is equal to the applied voltage V, consumption power W decreases as capacitance C becomes smaller. That is, the smaller the dielectric constant $\in$ becomes, the lower the consumption power becomes (See Transactions of the Institute of Electrical Engineers of Japan, vol. 118–15, pp537–542, 1998).

As can be seen from the above description, consumption power required for driving the PDP in this embodiment can be saved by reducing the dielectric constant $\in$ of the dielectric layers. This improves its luminance efficiency.

The PDP in this embodiment can also reduce the burden on the driving circuit, compared with the conventional PDPs. This enables the driving circuit to perform with stability even at a high speed, which contributes to increasing the reliability of the PDP.

Conventional dielectric layers formed by sintering glass frit can suffer generation of bubbles during the sintering process and most of those bubbles remain in the dielectric layer. When this happens, withstand voltage of the dielectric layer decreases. But the dielectric layer in this embodiment, which is made from a silicone resin, does not sustain formation of bubbles during a period of heating and curing the dielectric layer. This makes the formed dielectric layer to have a withstand voltage.

Having dielectric layers with superior withstand voltage, the PDP is able to maintain a high panel luminance for a long period of repeated use. This would also be a factor that increases the reliability of the PDP.

Luminance and consumption power of PDPs are more greatly affected by the first dielectric layer 14 than the second dielectric layer 23 and the ribs 24. On this point, it is preferable to form the first dielectric layer 14 from a silicone resin, because it would improve its luminance and decrease the power consumption. It is also preferable that the first dielectric layer 14 is thicker than the second dielectric layer 23.

Modification

The following is a modification of the present invention in which parts of the first dielectric layer 14 are made thinner than other parts in which a discharge is supposed to occur.

Figure 8:
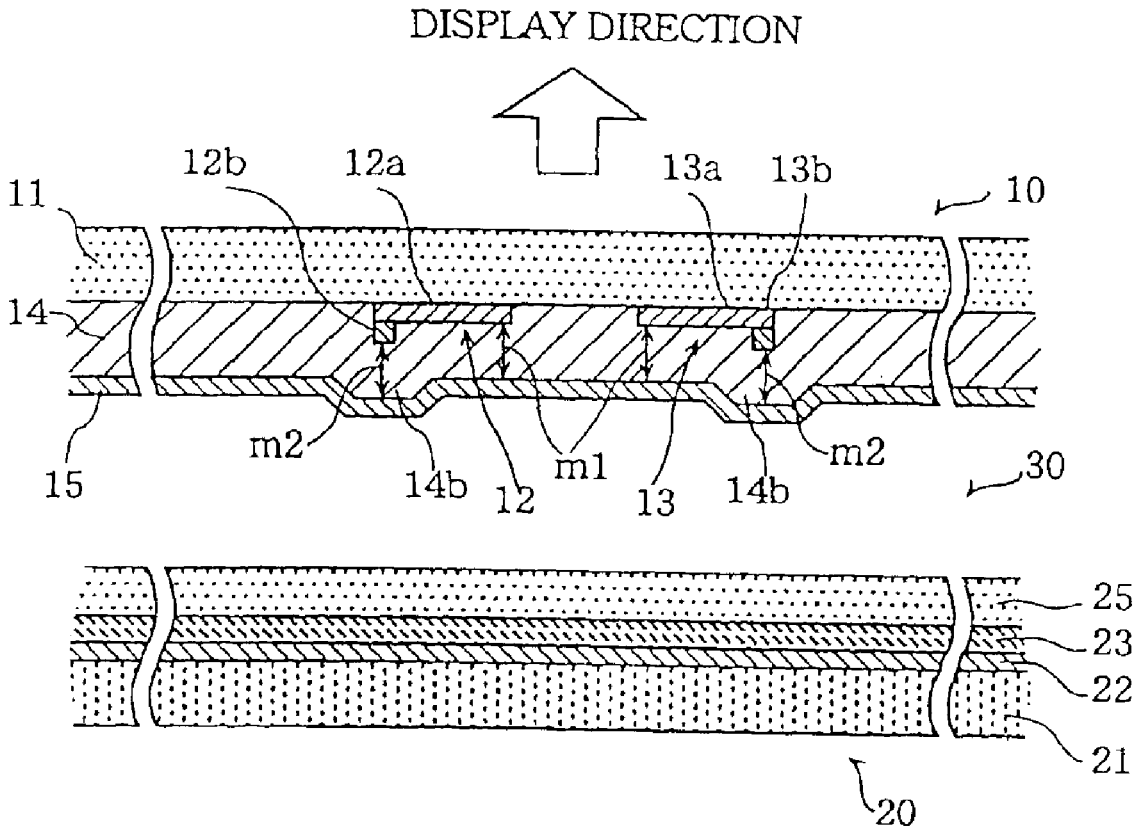
FIG. 8 shows a modified example of the PDP.

The display electrodes 12–13 shown in FIG. 8 are lamination-type electrodes, with the bus electrodes 12*b* and 13*b* laminated on the transparent electrodes 12*a* and 13*a*. Here, the first dielectric layer 14 has a convex portion 14*b* corresponding to an area where the bus electrodes 12*b* and 13*b* are provided. The distance m2 between the first dielectric layer 14 and the bus electrodes 12*b*–13*b* is greater than the distance m1 between the first dielectric layer 14 and the transparent electrodes 12*a*–13*a*.

There are some advantages if there is a difference in the thickness of the first dielectric layer 14.

In a PDP1 that has display electrodes 12–13 composed of transparent electrodes 12*a*–13*a* and bus electrodes 12*b*–13*b* laminated thereon, when it is driven, a discharge takes place during an address discharge period within a space left between the scanning electrode 12 and the address electrode 22, mainly in a space between the bus electrode 12*b* and the address electrode 22. But because the electrode 12*b* goes beyond the transparent electrode 12*a*, forming thinner dielectric layer on the bus electrode 12*b* means a higher possibility of dielectric breakdown taking place.

By contrast, the PDP1 of FIG. 8 is free from dielectric breakdown during the address discharge, because the address discharge occurs in the portions of the first dielectric layer 14 where its thickness (m2) is greater than the other. This ensures a writing to be performed in good condition.

When a sustain discharge occurs between the scanning electrode 12 and the sustain electrode 13, it takes place substantially between the transparent electrode 12*a* and the transparent electrode 13*a*, which is the narrowest part of the dielectric layer 14 (with a thickness m1). This intensifies the electric field strength in the discharge cell, enabling to produce light at a high luminance rate.

The first dielectric layer 14 having such convex portion 14*b* can be formed by the same method as that for producing the ribs of FIG. 4. Which is to say, a silicone film is formed over the entire front glass plate 11 after the display electrodes 12–13 have been formed on it. The silicone film is pressed with a mold that has a concave portion corresponding to the convex portion 14. The silicone film is transformed to a convex shape, and then heated and cured at temperatures 200–300 degrees C.

EXAMPLES

Actual Example PDPs No.1–5 were produced in accordance with the description about the above embodiment.

The first dielectric layers can be made of silicones. The second dielectric layers and ribs are made from a mixture of polymethylsiloxane resin and $SiO_2$.

The materials for the dielectric layer and ribs are applied by process printing or spin coat method.

The example PDP No. 6 is a comparison example whose dielectric layers and ribs are made of PbO glass (with a dielectric constant of 11).

The following describes the specification used commonly for the actual and comparison examples.

The front glass plate and the back glass plate can be a 2 mm thick soda lime glass plate. The cell size of these PDPs is determined according to a 42-inch VGA display; the ribs 24 are 0.15 mm high, the distance between any neighboring ribs 24 (cell pitch) is 0.36 mm, and the distance between the discharge electrodes 12*d* is 0.08 mm (with 480 discharge electrodes and 2556 address electrodes). The thickness of the second dielectric layer is 15 $\mu$m. A discharge gas is a Ne—Xe mixed gas containing 5 vol % of Xe. It is put into the cells with a pressure of 600 Torr ($7.8\times10^4$ Pa). The protective layer 15 is formed of MgO by sputtering. It is about 1.0 $\mu$m thick.

EXPERIMENTS

For each PDP of the actual examples and comparison example, the following measurements were taken.

(a) Dielectric Constant of the Dielectric Layer

Dielectric constant of the dielectric layer 14 in PDP1 was obtained using LCR meter (for instance, 4284A model manufactured by Hewlett-Packard Company).

In more detail, a plurality of display electrodes 12 and 13, which were arranged close to each other, were joined together to form a common electrode. Then, an Ag electrode was formed on the dielectric layer 14 so as to cover this common electrode. AC voltage was applied (with a frequency of 10 kHz) between the Ag electrode and the common electrode in order to measure capacitance C of the dielectric layer (capacitance C was shown on the LCR meter display).

Dielectric constant $\in$ of the dielectric layer 14 was determined by the equation 1 using the obtained capacitance value C (here, area of the common electrodes is substituted for S of the equation 1).

(b) Panel Luminance

Luminance was measured for each PDP when a discharge occurred in all the cells. For this measurement, a discharge sustain voltage is set at 180V and a frequency at 50 KHz.

(c) Panel Power

During the discharge period, voltage and current were measured. Based on these values, the value of power consumed by the panels was obtained.

(d) Considerations

The consumption power of the actual examples No. 1–5 were much lower than the comparison example No. 6. This is mainly because the dielectric layers of the actual examples are made of a low-dielectric constant silicone resin, compared with that of the comparison example.

Values of panel luminance for the actual examples No. 1–5 were slightly higher than that of comparison example No. 6. While the dielectric layer of the comparison example was colored due to the effect of Ag colloid diffusion, the dielectric layers of the actual examples were not colored. It is assumed that this may have contributed to the higher panel luminance of the actual examples.

Dielectric constant of the first dielectric layer of the actual example PDP is in the range of 2.8–3.0, suggesting that power consumption of the PDPs can be reduced by far when their dielectric constants are within that range.

Images displayed on the actual example PDPs were good enough to meet a practical level. It was confirmed that good picture quality is assured even if dielectric constant of the dielectric layer is 3.

Other Considerations

While in the above embodiment the first dielectric layer, the second dielectric layer and the ribs are all made in a silicone resin, the ribs may be made of glass with the first dielectric layer and the second dielectric layer being made from a silicone resin. In this case, too, the same effects can be expected.

It would be also possible to provide a combination of the first dielectric layer made of a silicone resin and the second dielectric layer made of glass, or a combination of the first dielectric layer made of glass and the second dielectric layer made of a silicone resin. Since dielectric constant of the first dielectric layer greatly affects the consumption power of the PDP, however, it is preferable that at least the first dielectric layer is made from a silicone resin.

In the above embodiment, the first dielectric layer is formed on the front panel and the second dielectric layer is formed on the back panel. But the PDP may have a back panel without a dielectric layer. In such a case, the same effect can be obtained by forming the first dielectric layer and the ribs from a silicone resin.

In the above embodiment, the second dielectric layer and the ribs are formed from a mixture of a silicone resin and a white pigment so that they can reflect visible light. But it is not essential to add the white pigment. They may be formed solely from a silicone resin or from a mixture of a silicone resin and a filler. In this case, too, the same effect can be obtained.

Although the ribs 24 are formed in straight lines in the above embodiment, they may be provided in a variety of shapes, including those of meandering shape and those arranged in a double cross. Such ribs are formed from a silicone resin and can be easily made by press-molding a rib material layer, as shown in FIG. 4.

Although the phosphor layers are formed on the side of the back panel in the above embodiment, they may be formed on the side of the front panel. They may also be formed on the side of both the front panel and the back panel.

Although the ribs are formed on the side of the back panel in the above embodiment, the ribs may be formed on the side of the front panel.

In the above embodiment, the ribs are provided in a space left between the front panel and the back panel. In place of the ribs, a gap member such as glass beads may be formed in the space left between the front panel and the back panel. Having its dielectric layers made of a silicone resin, such a PDP can retain the same effect.

Although the description in the above embodiment is about a surface discharge-type PDP, dielectric layers and ribs that are made from a silicone resin can be used in an opposed discharge-type PDP. In that case, too, the same effects can be obtained.

INDUSTRIAL APPLICATION

The PDP of the present invention is applicable to display devices for use in computers and televisions, and more particularly to large display devices that provide fine images.

What is claimed is:

1. A plasma display panel having a first plate, a second plate, and a gap member interposed in between the first plate and the second plate, a plurality of pairs of first electrodes being arranged in parallel with each other on a surface of the first plate, the plurality of pairs of first electrodes being covered by a first dielectric layer, a plurality of second electrodes being arranged in parallel with each other on a surface of the second plate, the first plate and the second plate being arranged so that the plurality of pairs of first electrodes face and extend across the plurality of second electrodes, a phosphor layer being formed on at least one of the facing surface of the first plate and the facing surface of the second plate, and a discharge gas being enclosed in a space left between the first plate and the second plate, to form a discharge space, wherein the first dielectric layer is formed from a first silicone resin having a siloxane bond.

2. The plasma display panel of claim 1, wherein in the first silicone resin, a Si atom of the siloxane bond is bonded with a group selected from the group consisting of methyl group, ethyl group and phenyl group.

3. The plasma display panel of claim 1, wherein the second electrodes formed on the second plate are covered with a second dielectric layer which is formed from a second silicone resin having a siloxane bond.

4. The plasma display panel of claim 3, wherein the second dielectric layer is made of a material containing a white pigment.

5. The plasma display panel of claim 3, wherein in the second silicone resin, a Si atom of the siloxane bond is bonded with a group selected from the group consisting of methyl group, ethyl group and phenyl group.

6. The plasma display panel of claim 1, wherein the gap member is formed from a third silicone resin having a siloxane bond.

7. The plasma display panel of claim 6, wherein the gap member is formed on the second plate, serves as ribs to partition the space, and is formed from a material containing a white pigment.

8. The plasma display panel of claim 1, wherein a MgO protective layer is formed on a surface of the first dielectric layer.

9. The plasma display panel of claim 1, wherein the first dielectric layer has a dielectric constant of 4.0 or below.

10. The plasma display panel of claim 1, wherein the first plate and the second plate are joined together by means of a sealing member, the sealing member being made of a fourth silicone resin and applied to peripheral portions of the first plate and the second plate.

11. A plasma display panel, (claim 1).

wherein the first dielectric layer has a dielectric constant of 4.0 or below.

12. A manufacturing method for a plasma display panel that includes a dielectric layer forming step, the dielectric layer forming step comprising:

a silicone layer forming step for forming a layer from a dielectric material containing silicone so as to cover the electrodes that have been formed on the plate; and a curing step for curing the formed silicone layer.

13. The manufacturing method of claim 12, wherein in the silicone layer forming step, the silicone layer is formed by applying the dielectric material with a spin coat method or a printing method.

14. The manufacturing method of claim 12, wherein the silicone layer forming step includes:

a first sub-step for laminating the dielectric material containing silicone on a transfer substrate; and a second sub-step for transferring the dielectric material layer formed in the first sub-step, to the plate, on which the electrodes have been formed.

15. The manufacturing method of claim 12 further comprising:

a dielectric material making step, prior to the silicone layer forming step, for making the dielectric material by adding a white pigment to silicone.

16. The manufacturing method of claim 12, wherein in the curing step, an uncured dielectric material layer is heated to be cured with the highest temperatures ranging from 200 to 300 degrees C.

17. The manufacturing method of claim 12 further comprising:

a sealing step, after the dielectric material layer forming step, for placing the plate so as to face another plate, inserting a silicone sealing material layer between the two plates, and curing the sealing material layer to join the two plates.

18. A manufacturing method for a plasma display panel that includes a rib forming step, the rib forming step comprising:

a press-molding step for press-molding a rib material in the shape of ribs, the rib material containing silicone, and arranging the ribs on a plate on which electrodes have been formed; and a curing step for curing the press-molded uncured rib material.

19. The manufacturing method of claim 18, wherein the press-molding step includes:

a first sub-step for arranging the uncured rib material on the plate; and a second sub-step for transforming or removing parts of the rib material, to form ribs.

20. The manufacturing method of claim 18, wherein the manufacturing method further includes:

an uncured rib material making step, prior to the press-molding step, for making the uncured rib material by adding a white pigment to silicone.

21. The manufacturing method of claim 18, wherein in the curing step, the press-molded uncured rib material is heated to be cured with the highest temperatures ranging from 200 to 300 degrees C.

22. The manufacturing method of claim 18 further includes:

a sealing step, after the rib forming step, for placing the plate so as to face another plate, inserting a silicone sealing material layer between the two plates, and curing the sealing material layer to join the two plates.

* * * * *

UNITED STATES PATENT AND TRADEMARK OFFICE

CERTIFICATE OF CORRECTION

PATENT NO. : 6,940,227 B2 
APPLICATION NO. : 10/239107
DATED : September 6, 2005
INVENTOR(S) : Aoki et al.

It is certified that error appears in the above-identified patent and that said Letters Patent is hereby corrected as shown below:

On the 1st page, (*) Notice: Subject to any disclaimer, the term of this patent is extended or adjusted under 35 U.S.C. 154 (b) by [0] --187-- days.

In Column 11, line 4, before "EXAMPLES", insert the following Table 1:

TABLE 1

| Example No. | Material for First Dielectric Layer | Thickness of First Dielectric Layer (μm) | Dielectric Constant of First Dielectric Layer | Material for Second Dielectric Layer & Rib | Dielectric Constant of Second Dielectric Layer | Manufacturing Temp (°C) of Dielectric Layer & Rib | Luminance (cd/m²) of Panel | Consumption Power (W) of Panel |
|---|---|---|---|---|---|---|---|---|
| 1 | Acryl Modified Silicone Resin (Duracion SE5650) | 20 | 3.0 | Mixture of Polydimethylsiloxane & $SiO_2$ | 2.9 | 200 | 540 | 350 |
| 2 | Polydimethylsiloxane | 15 | 2.8 | Mixture of Polydimethylsiloxane & $SiO_2$ | 2.9 | 250 | 550 | 380 |
| 3 | Methylphenylpolysiloxane | 15 | 2.9 | Mixture of Polydimethylsiloxane & $SiO_2$ | 2.9 | 300 | 550 | 385 |
| 4 | Epoxy Modified Silicone Resin Epikote 828 (Shell Chemicals) | 20 | 2.9 | Mixture of Polydimethylsiloxane & $SiO_2$ | 2.9 | 200 | 545 | 354 |
| 5 | Organic Siloxane HSG-R7 (Hitachi Chemical) | 15 | 2.8 | Mixture of Polydimethylsiloxane & $SiO_2$ | 2.9 | 250 | 550 | 382 |
| 6 | PbO Glass | 25 | 11 | Mixture of PbO Glass & $TiO_2$ | 15 | 590 | 535 | 830 |

*Example No. 6 is Comparison Example

Signed and Sealed this

Seventh Day of November, 2006

JON W. DUDAS
*Director of the United States Patent and Trademark Office*

UNITED STATES PATENT AND TRADEMARK OFFICE

CERTIFICATE OF CORRECTION

PATENT NO. : 6,940,227 B2
APPLICATION NO. : 10/239107
DATED : September 6, 2005
INVENTOR(S) : Masaki Aoki et al.

It is certified that error appears in the above-identified patent and that said Letters Patent is hereby corrected as shown below:

On the Title Page (75) add:

--Kazuya Hasegawa, Neyagawa (JP)--

Signed and Sealed this

Ninth Day of October, 2007

JON W. DUDAS
*Director of the United States Patent and Trademark Office*